US010701497B2

(12) United States Patent
Chana et al.

(10) Patent No.: US 10,701,497 B2
(45) Date of Patent: Jun. 30, 2020

(54) HEARING DEVICE SEAL MODULES, MODULAR HEARING DEVICES INCLUDING THE SAME AND ASSOCIATED METHODS

(71) Applicant: Sonova AG, Stäfa (CH)

(72) Inventors: Barjinder Chana, San Jose, CA (US); Michael Au, Union City, CA (US); Erdal Karamuk, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/140,322

(22) Filed: Sep. 24, 2018

(65) Prior Publication Data

US 2020/0100037 A1 Mar. 26, 2020

(51) Int. Cl.
*H04R 25/00* (2006.01)
*H04R 25/02* (2006.01)

(52) U.S. Cl.
CPC ..... *H04R 25/652* (2013.01); *H04R 25/60* (2013.01); *H04R 25/604* (2013.01); *H04R 25/02* (2013.01)

(58) Field of Classification Search
CPC .... H04R 25/02; H04R 25/606; H04R 25/625; H04R 2225/023
See application file for complete search history.

(56) References Cited

U.S. PATENT DOCUMENTS

| | | | | |
|---|---|---|---|---|
| 4,880,076 | A | 11/1989 | Ahlberg et al. | |
| 5,002,151 | A | 3/1991 | Oliveira et al. | |
| 6,129,174 | A | 10/2000 | Brown et al. | |
| 7,664,282 | B2 | 2/2010 | Urso et al. | |
| 8,477,978 | B2 * | 7/2013 | Caldarola | H04R 25/02 181/130 |
| 8,682,016 | B2 | 3/2014 | Wagner et al. | |
| 8,761,423 | B2 | 6/2014 | Wagner et al. | |
| 2005/0123163 | A1 | 6/2005 | Oliveira et al. | |
| 2009/0074220 | A1 | 3/2009 | Shennib | |
| 2009/0202097 | A1 * | 8/2009 | Tiscareno | H04R 1/1016 381/380 |
| 2014/0010396 | A1 * | 1/2014 | Karamuk | H04R 25/60 381/328 |
| 2015/0382094 | A1 * | 12/2015 | Grinker | H04R 1/1058 381/380 |

* cited by examiner

*Primary Examiner* — Sunita Joshi
(74) *Attorney, Agent, or Firm* — Henricks Slavin LLP

(57) ABSTRACT

A hearing device seal module having a tubular seal carrier formed from resilient material, defining a medial-lateral axis and a lumen configured for passage of the hearing device core, and including a seal support region with a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the seal support region is in an unstressed state, and a first seal secured to the first portion of the seal support region and extending outwardly therefrom.

19 Claims, 10 Drawing Sheets

FIG. 20
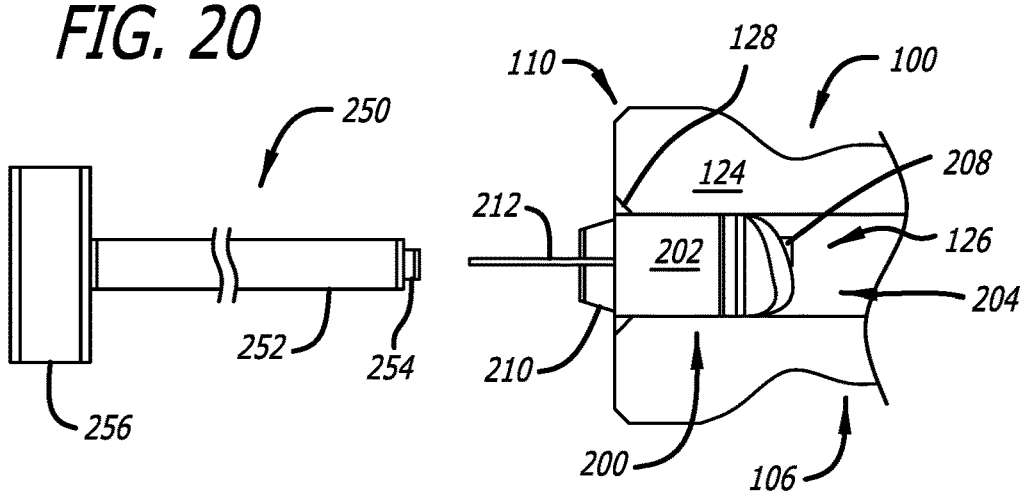
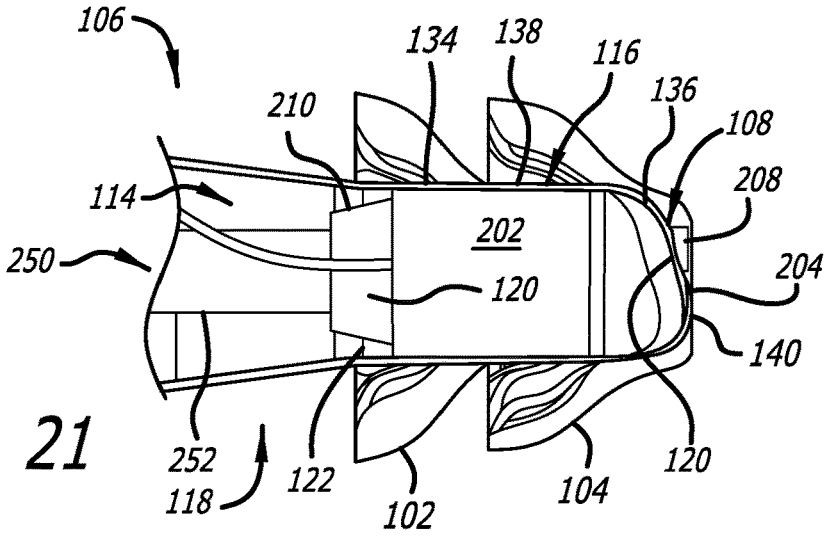
FIG. 21
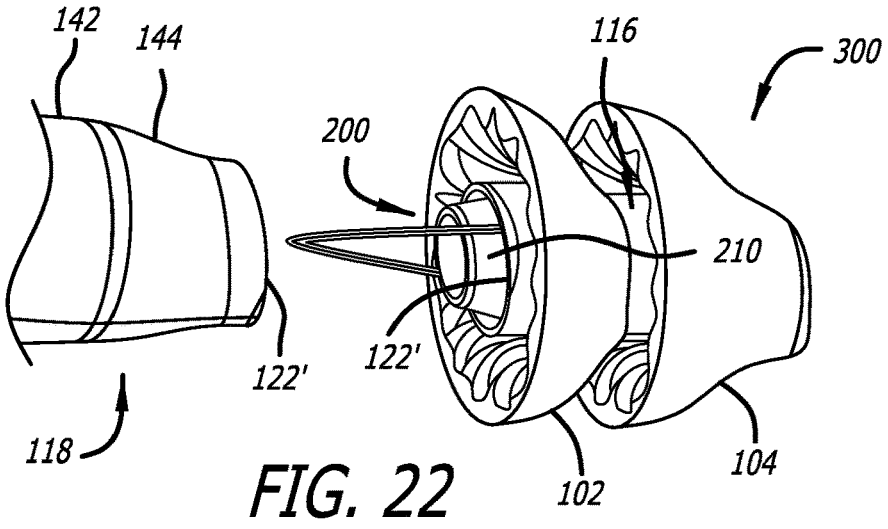
FIG. 22

HEARING DEVICE SEAL MODULES, MODULAR HEARING DEVICES INCLUDING THE SAME AND ASSOCIATED METHODS

BACKGROUND

1. Field

The present inventions relate generally to hearing devices and, for example, hearing devices that are worn in the ear canal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. Nos. 7,664,282 and 8,682,016, each of which is incorporated herein by reference. Referring to FIGS. 2 and 3, the exemplary hearing device 50 includes a core 52, a medial and lateral seal retainers (or "seals") 54 and 56, and a removal loop 58. A contamination guard 60 with a screen (not shown) abuts the microphone. The core 52 includes a housing as well as a battery, a microphone, a receiver, and control circuitry located within the housing. The seals 54 and 56 suspend and retain the hearing device core 52 within the ear canal and also suppress sound transmission and feedback which can occur when there is acoustic leakage between the receiver and microphone. The seals 54 and 56 are frequently formed from a highly porous and highly compliant foam material (e.g., hydrophilic polyurethane foam), which conforms to the ear canal geometry by deflection and compression, as is illustrated in FIG. 4. The seals 54 and 56 are glued or otherwise permanently secured to the core 52 at the manufacturing site.

It is especially important that the seals be properly sized for the intended ear canal. An extended wear hearing device with improperly sized seals may result in a less than optimal insertion depth within the ear canal and/or gaps and folds in the seal. Less than optimal insertion depth and/or a poor seal/ear canal interface may result in, for example, discomfort, injury to the ear canal, and inadequate acoustic feedback suppression. Given the fact that hearing devices are placed in ear canals of varying shapes and sizes, hearing device manufactures typically manufacture hearing devices with a variety of seal sizes. For example, a particular hearing device may be manufactured with any of seven different seal sizes (i.e., XXS, XS, S, M, L, XL and XXL), or combinations of sizes. The hearing device seal size is typically determined during the fitting process and the patient is provided with a pre-sized hearing device with appropriately sized seals.

The present inventors have determined that there are a number of shortcomings associated with conventional methods of assembling hearing devices. For example, because the seals are glued or otherwise permanently secured to the core at the manufacturing site, fitting facilities must stock a large number of hearing devices in order to ensure that they have an appropriately sized hearing device for each patient. The carrying costs of maintaining a wide variety of sizes can be quite high, especially given the fact that some of the hearing devices will expire while in storage. Permanently securing the seals to the core at the manufacturing site also eliminates the ability of the fitting facility to provide customized seal combinations such as, for example, a lateral seal that is larger than a medial seal in a so-called conical arrangement.

It should also be noted that various mechanical interconnects such as locking mechanisms and threaded connectors have been proposed for connecting seals to hearing device cores, especially in the context of receiver in the canal ("RIC") hearing devices. The present inventors have determined that such interconnects can be difficult to use given the small size of the RIC hearing devices, and are nevertheless too large to be used on completely in the canal ("CIC") hearing devices.

SUMMARY

A hearing device seal module in accordance with at least one of the present inventions includes a tubular seal carrier formed from resilient material, defining a medial-lateral axis and a lumen configured for passage of the hearing device core, and including a seal support region with a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the seal support region is in an unstressed state, and a first seal secured to the first portion of the seal support region and extending outwardly therefrom.

The present inventions also include hearing device systems that include a hearing device core and such a hearing device seal module as well as systems that include a hearing device core and a plurality of such hearing device seal modules with different seal configurations.

A hearing device assembly method in accordance with at least one of the present inventions includes the step of positioning a hearing device seal module, including a resilient tubular seal carrier with a seal support region and a first seal secured to the seal support region, onto a hearing device core in such a manner that a portion of the tubular seal carrier that is lateral of the first seal is stretched over the hearing device core.

There are a variety of advantages associated with the present hearing device seal modules and associated methods. For example, the present hearing device seal modules and associated methods allow fitting facilities to secure appropriately sized seals onto hearing device cores at the time of fitting by simply pushing the core into the seal module. The seals may also be removed and replaced if necessary based on, for example, patient feedback. A wide variety of seal sizes may be stored (as portions of seal modules) at the fitting facility, including rarely used sizes and differently sized seals on the same module, because the seals (and the present seal modules) are relatively inexpensive and are unlikely to expire prior to use. As such, the present hearing device seal modules and associated methods allow fitting facilities to store an appropriate number of hearing device cores, based on the expected number of patients and without regard to seal size, thereby reducing carrying costs and waste due to core expiration.

The many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 20 is a side, partial section view showing a portion of an exemplary hearing device assembly method employing the hearing device seal module illustrated in FIG. 5.

FIG. 21 is a side, partial section view showing a portion of an exemplary hearing device assembly method employing the hearing device seal module illustrated in FIG. 5.

FIG. 22 is a perspective view showing a portion of an exemplary hearing device assembly method employing the hearing device seal module illustrated in FIG. 5.

DETAILED DESCRIPTION OF EXEMPLARY EMBODIMENTS

Figure 1:
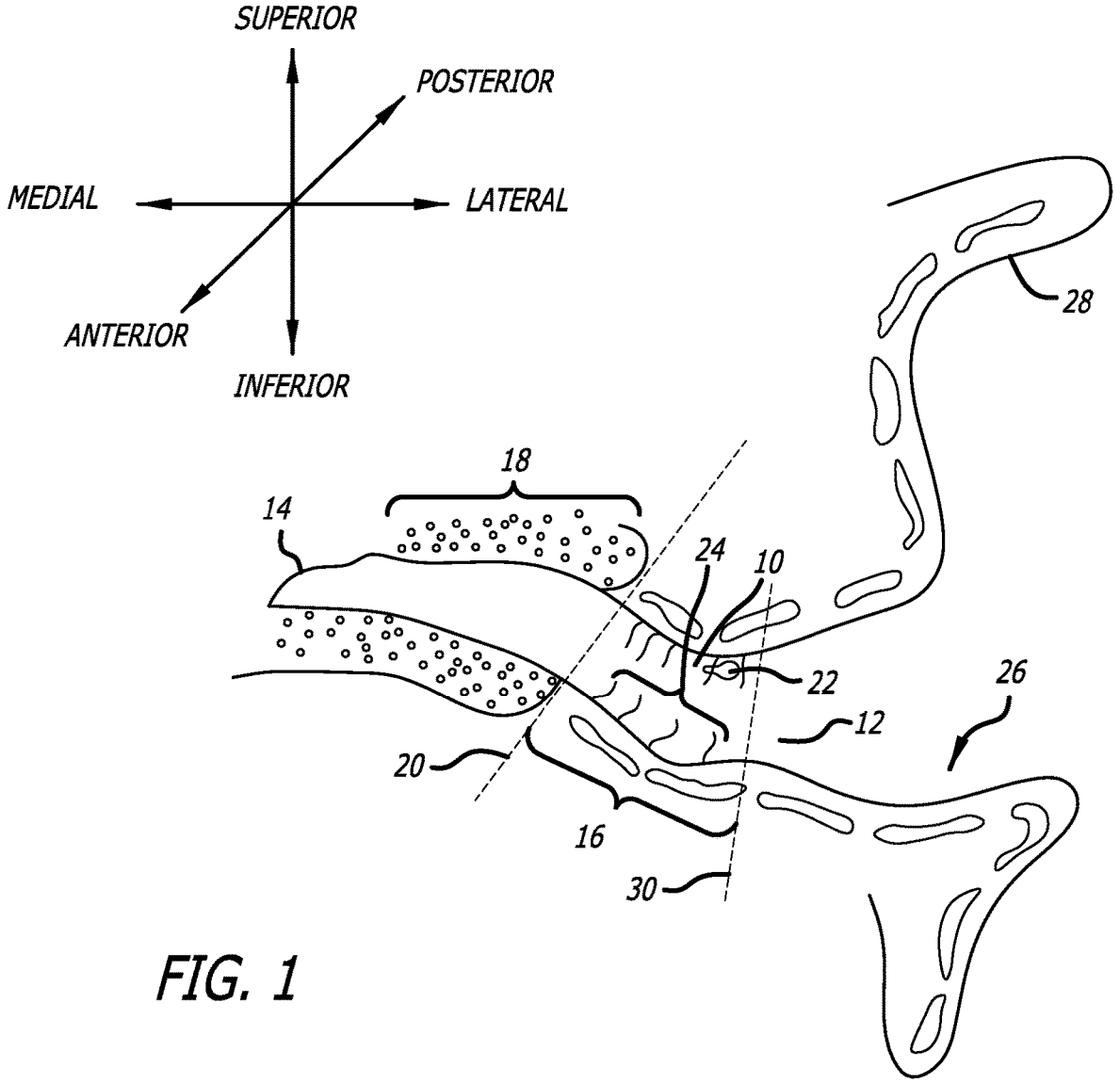
FIG. 1 is a section view showing the anatomical features of the ear and ear canal.
Figure 2:
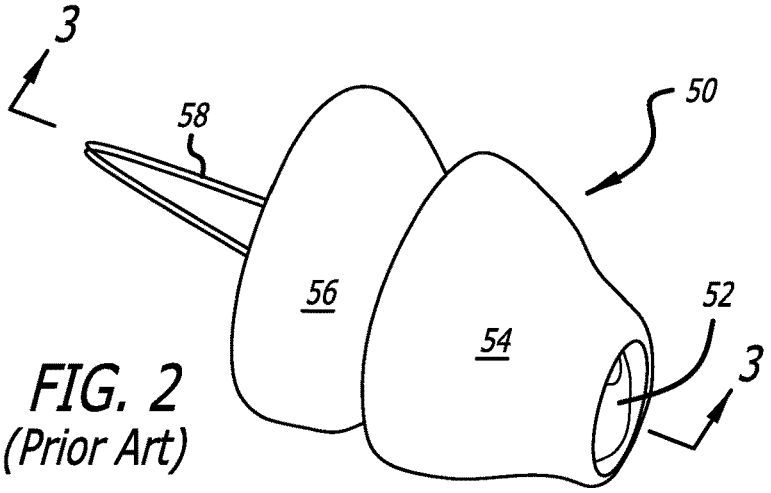
FIG. 2 (Prior Art)
FIG. 2 is a perspective view of a conventional hearing device.
Figure 3:
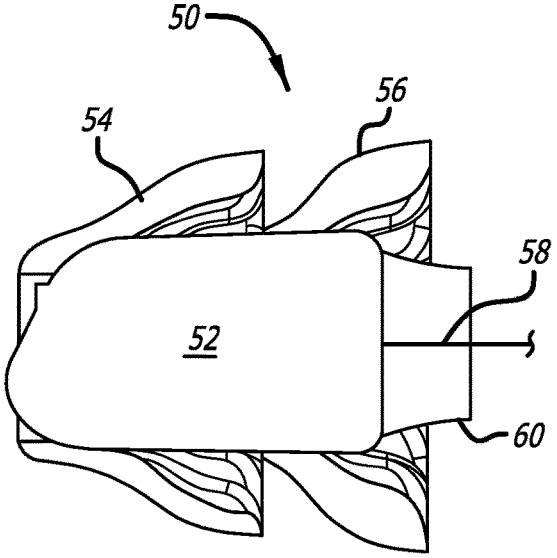
FIG. 3 (Prior Art)
FIG. 3 is a partial section view taken along line 3-3 in FIG. 2.
Figure 4:
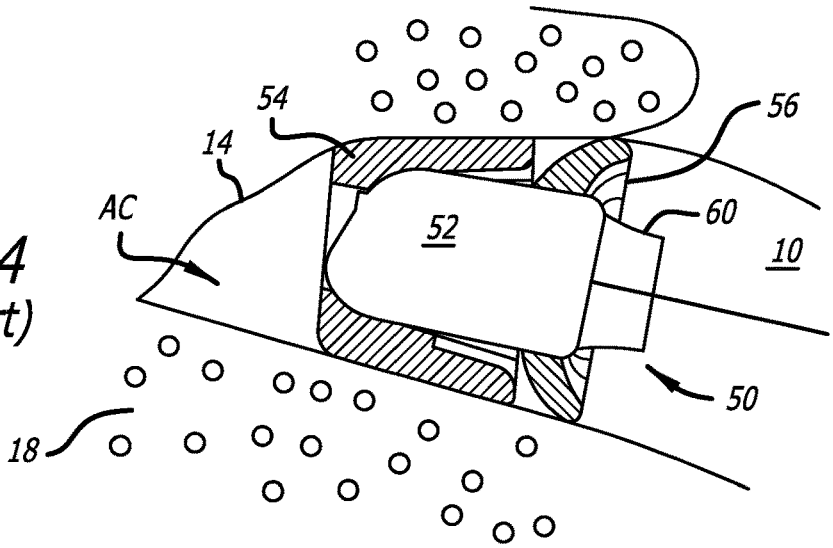
FIG. 4 (Prior Art)
FIG. 4 is a partial section view showing the hearing device illustrated in FIGS. 2 and 3 within the ear canal.

The following is a detailed description of the best presently known modes of carrying out the inventions. This description is not to be taken in a limiting sense, but is made merely for the purpose of illustrating the general principles of the inventions. Referring to FIG. 1, it should also be noted that as used herein, the term "lateral" refers to the direction and parts of hearing devices which face away from the tympanic membrane when within an ear canal, the term "medial" refers to the direction and parts of hearing devices which face toward the tympanic membrane when within an ear canal, the term "superior" refers to the direction and parts of hearing devices which face the top of the head when within an ear canal, the term "inferior" refers to the direction and parts of hearing devices which face the feet when within an ear canal, the term "anterior" refers to the direction and parts of hearing devices which face the front of the body when within an ear canal, and the "posterior" refers to the direction and parts of hearing devices which face the rear of the body when within an ear canal.

Figure 5:
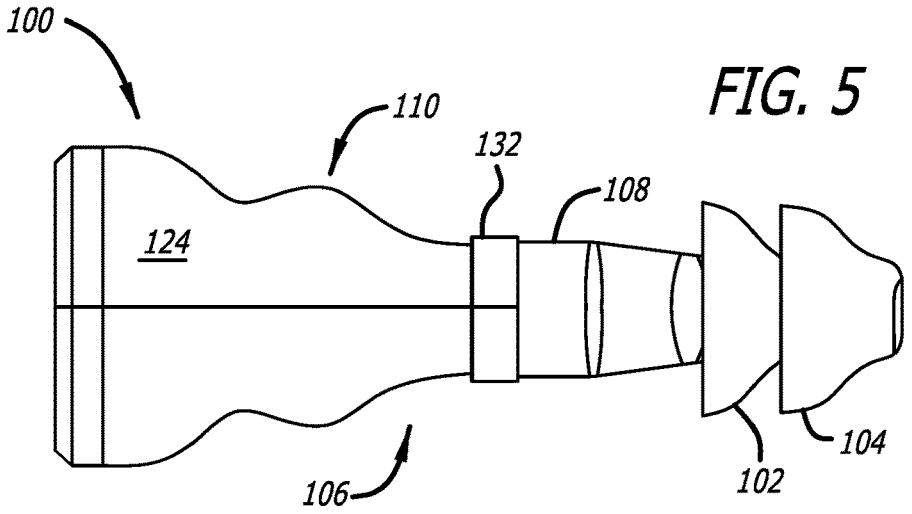
FIG. 5 is a side view of a hearing device seal module in accordance with one embodiment of a present invention.
Figure 6:
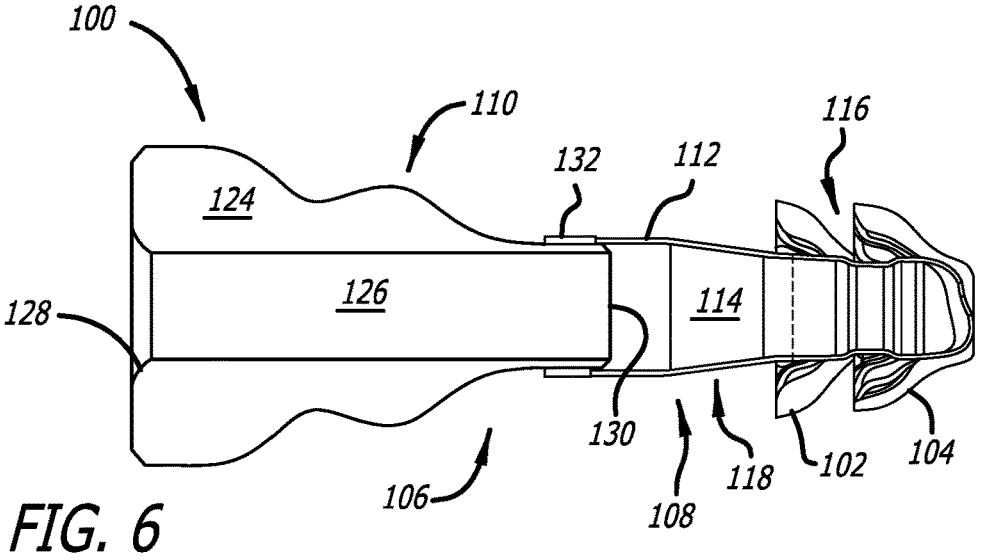
FIG. 6 is a section view of the hearing device seal module illustrated in FIG. 5.
Figure 7:
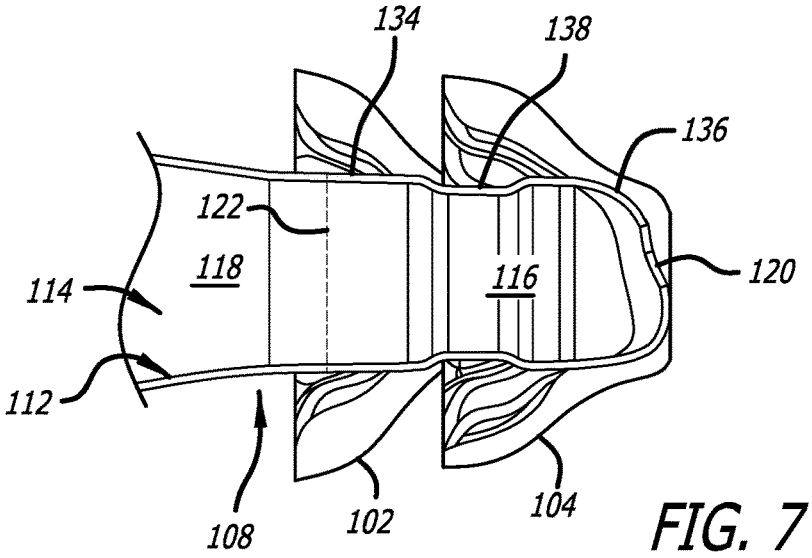
FIG. 7 is a section view of a portion of the hearing device seal module illustrated in FIG. 5.

As illustrated in FIGS. 5-7, an exemplary hearing device seal module 100 in accordance with one embodiment of a present invention includes seals 102 and 104 and an assembly apparatus 106 that may be used both to position the seals onto a hearing device core (or "core") and to secure the seals to the hearing device core. The seals 102 and 104 may be secured to the assembly apparatus 106 through the use of adhesive or any other suitable instrumentality. In at least some instances, the assembly apparatus 106 will semi-permanently secure the seals to the hearing device core. As used herein, seals that are "semi-permanently secured" to the hearing device core are seals that will remain secured to the core under expected use conditions and that can be removed from the core without damage to the core if so desired. For example, should it be determined during fitting that the seals 102 and 104 are not the most optimal size, the seals may be removed from the core and replaced with seals from another seal module 100.

Although the present modules are not limited to any particular type of hearing device seal, the exemplary seals 102 and 104 are the same as those commonly employed on extended wear hearing devices and, accordingly, are configured to substantially conform to the shape of walls of the ear canal, maintain an acoustical seal between a seal surface and the ear canal, and retain the hearing device core securely within the ear canal. Additional information concerning the specifics of exemplary seals may be found in U.S. Pat. No.

7,580,537, which is incorporated herein by reference. With respect to materials, the seals 102 and 104 be formed from compliant material configured to conform to the shape of the ear canal. Suitable materials include elastomeric foams having compliance properties (and dimensions) configured to conform to the shape of the intended portion of the ear canal (e.g., the bony portion) and exert a spring force on the ear canal so as to hold the core in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example.

The exemplary assembly apparatus 106 illustrated in FIGS. 5-7 includes a tubular seal carrier 108 and a handle 110. The seal carrier 108, which is discussed in greater detail below with reference to FIGS. 9-16, has an outer wall 112 that defines an internal lumen 114, a seal support region 116, and a connector region 118 that extends from the seal support region to the handle 110. The medial end of the seal carrier 108 has a sound aperture 120. A weakened area 122, defined for example by a score line or spaced perforations, facilitates separation of the seal support region 116 from the connector region 118 after the seal support region secures the seals 102 and 104 to a hearing device core, as is discussed below with reference to FIG. 22. Turning to the handle 110, the exemplary handle includes a handle body 124 with a lumen 126, having an inlet 128 and an outlet 130, extending therethough for passage of a hearing device core. As compared to an otherwise identical assembly apparatus without the handle 110, the present assembly apparatus is easier to use because the handle holds the tubular seal carrier 108 open during insertion of the hearing device core. The handle 110 may also have an undulating shape to make it easier to grip, although other suitable handle shapes may be employed. The tubular seal carrier 108 may be mounted onto the handle 110 in any suitable manner. In the illustrated implementation, an adhesive strip 132 is employed.

It should also be noted here that handle need not be a separate structural element that is attached to the associated tubular seal carrier in the manner described above. For example, the handle and tubular seal carrier may be an integrally formed structure, although the wall thickness of the tubular handle will be greater than that of the tubular seal carrier so that the handle holds its shape (and holds the tubular seal carrier in an open state).

Figure 8:
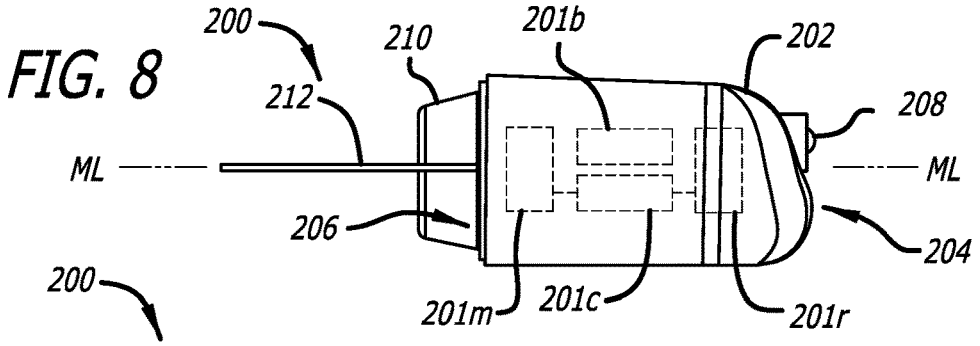
FIG. 8 is a side view of a hearing device core.
Figure 9:
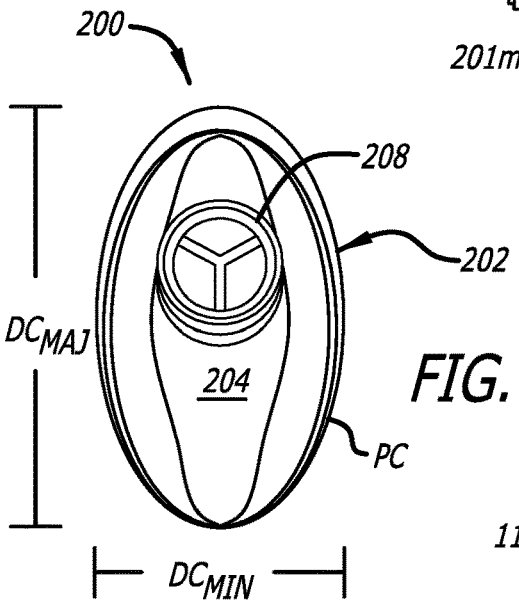
FIG. 9 is an end view of the hearing device core illustrated in FIG. 8.

One example of a hearing device core is the core 200 illustrated in FIGS. 8 and 9. The exemplary core 200 includes a housing 202, with medial and lateral ends 204 and 206 and a receiver port 208, a contamination guard 210 with a screen (not shown), and a removal loop 212. The exemplary core 200 also includes a battery 201*b*, a microphone 201*m*, a receiver 201*r*, and control circuitry 201*c* that are operably connected to one another and are located within the housing 202. Exemplary hearing device cores are illustrated and described in, for example, U.S. Pat. No. 8,761,423, which is incorporated herein by reference. The present inventions are not, however, limited to any particular type of hearing device core.

Although the present cores are not limited to any particular shapes, the exemplary hearing device core 200 illustrated in FIGS. 8 and 9 has an oval shape (e.g., an elliptical or at least substantially elliptical shape), defined by the outer surface of the housing 202, in planes perpendicular to the medial-lateral axis ML that extends through the center of the hearing device. The oval shape defines a major dimension $DC_{MAJ}$, a minor dimension $DC_{MIN}$, and an outer perimeter PC. These dimension taper (or "decrease") slightly in the lateral to medial direction in the exemplary implementation. Additionally, the receiver port 208 is not centered on the medial-lateral axis ML. Put another way, the housing 202 and the receiver port 208 are not coaxial.

Figure 10:
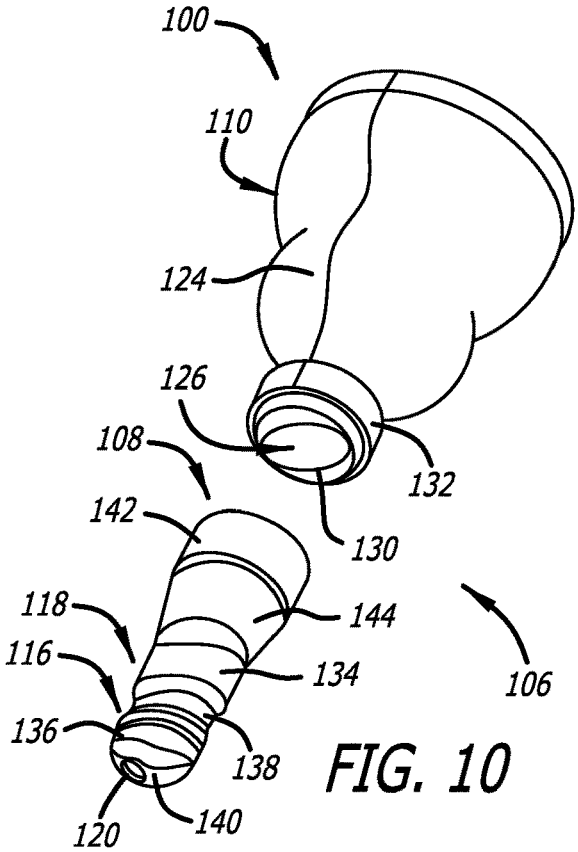
FIG. 10 is an exploded perspective view of a portion of the hearing device seal module illustrated in FIG. 5.
Figure 11:
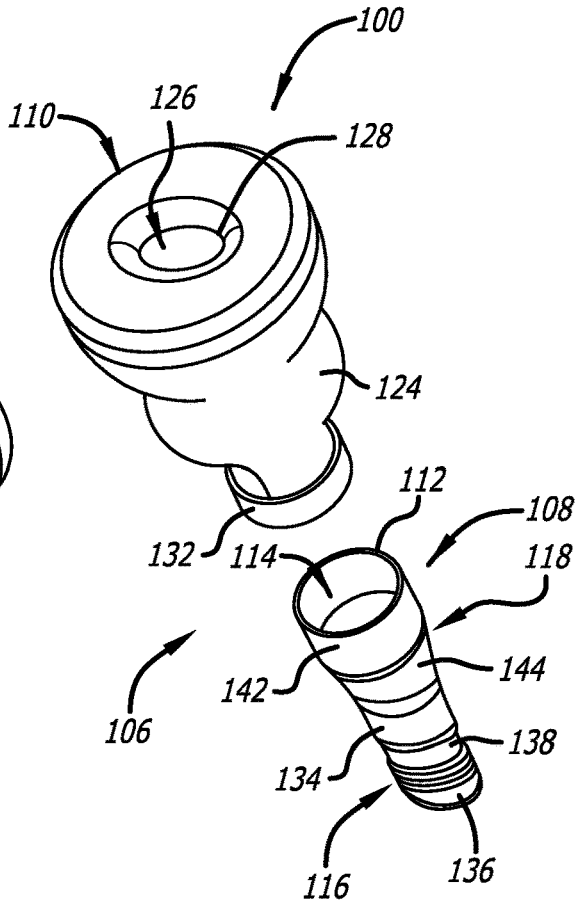
FIG. 11 is an exploded perspective view of a portion of the hearing device seal module illustrated in FIG. 5.
Figure 12:
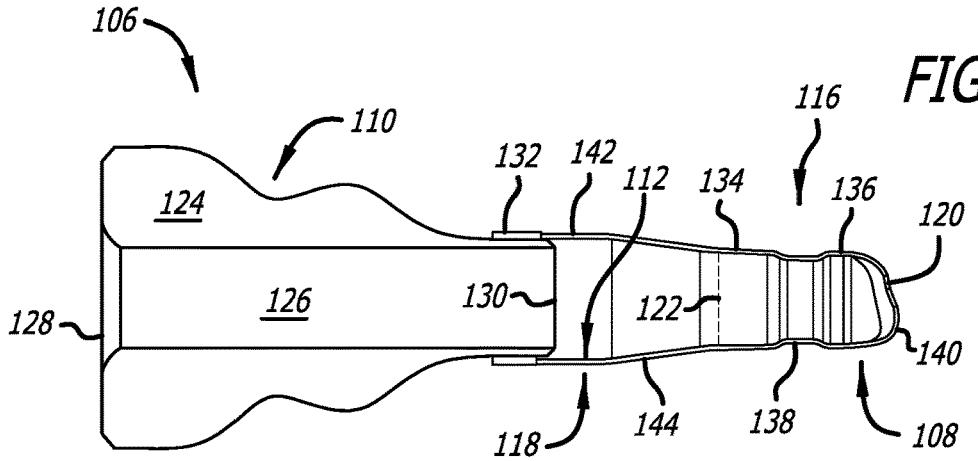
FIG. 12 is a section view of a portion of the hearing device seal module illustrated in FIG. 5.
Figure 13:
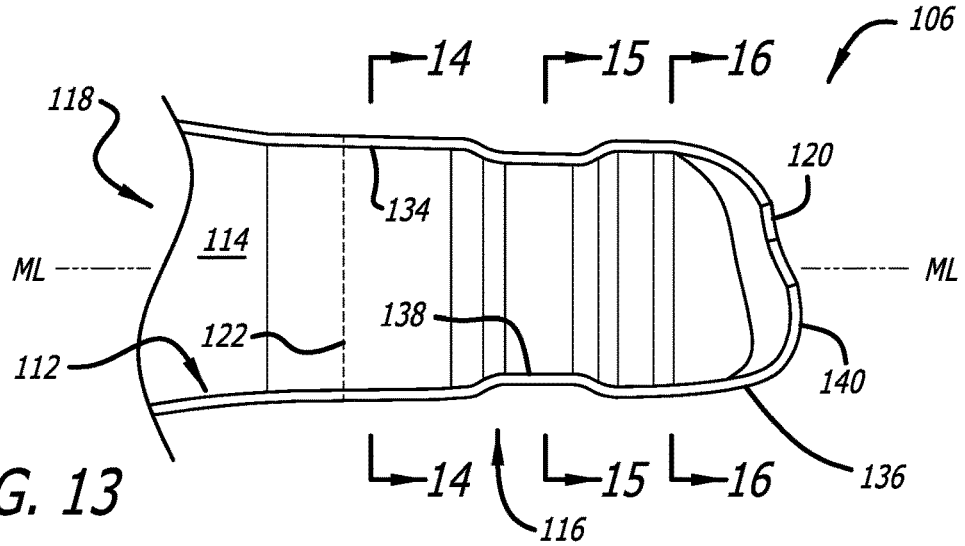
FIG. 13 is a section view of a portion of the hearing device seal module illustrated in FIG. 5.
Figure 14:
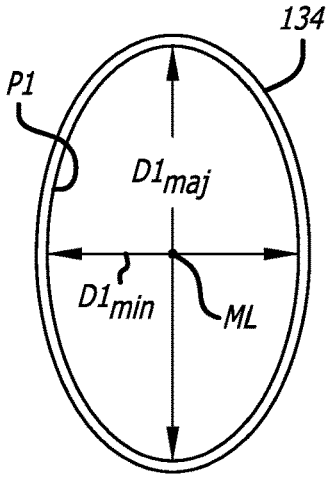
FIG. 14 is a section view taken along line 14-14 in FIG. 13.
Figure 15:
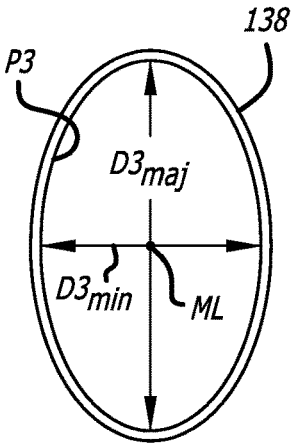
FIG. 15 is a section view taken along line 15-15 in FIG. 13.
Figure 16:
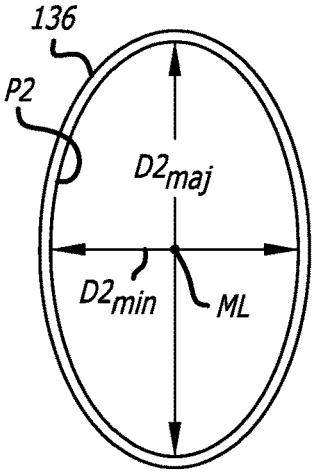
FIG. 16 is a section view taken along line 16-16 in FIG. 13.

Turning to FIGS. 10-12, the exemplary hearing device seal module 100 is configured to create an interference fit with the associated hearing device core 200 and, given that the seals 102 and 104 are part of the seal module, secure the seals to the core. In particular, the seal support region 116 of the exemplary seal carrier 108 is configured to create an interference fit with the hearing device core 200. In at least some instances, the exemplary seal carrier 108 is configured to create an interference fit with the hearing device core 200 that will semi-permanently secure the seals 102 and 104 to the core so that the seals will remain secured to the core under expected use conditions and can be removed from the core, along with the associated portion of the seal carrier 108, without damage to the core.

In the embodiment illustrated in FIGS. 10-12, the seal support region 116 of the exemplary seal carrier 108, which is shown here in its unstretched (or "relaxed" or "unstressed") state, has a lateral portion 134, a medial portion 136, a central portion 138 located between the medial and lateral portions, and a medial end 144. In the illustrated implementation, seal 102 may be secured to the lateral portion 134 of the support region 116, seal 104 may be secured to the medial portion 136 of the support region, and central portion may be located between the seals, in the manner illustrated in FIG. 7. The connector region 118 has a lateral portion 142 that is secured to the handle 110 and a medial portion 144 that abuts the seal support region 116 at the weakened area 122.

The aforementioned interference fit is created when at least the central portion 138 resiliently stretches as the associated core 200 is pushed into the seal support region 116. As such, the respective dimensions of the seal carrier 138 and the associated hearing device core 200 are such that at least the central portion 138 is smaller than the portion of the associated core 200 that is aligned therewith when the core is fully inserted into the seal carrier 108, i.e., when the medial end 204 of the core housing 202 abuts the medial end 140 of the seal carrier seal support region 116. The material used to form the wall 112 of the seal carrier 108, or at least the seal support region 116 thereof, may be a relatively thin (e.g., 10-20 μm) material that is resilient and, in at least some embodiments, relatively tacky. Suitable materials include, but are not limited to, polyurethane and silicone.

Referring more specifically to FIGS. 13-16, the seal support region 116 of the exemplary seal carrier 108 (which is shown here in a relaxed, or unstressed, state) defines a shape, size and resilience that results in an interference fit with the associated hearing device core 200 when the core is in the seal support region 116. In particular, the shape, size and resilience of at least the central portion 138 will result in the resilient stretching (or "elastic deformation" or "a stressed state") of at least the central portion when the core is in the seal support region 116. In the illustrated implementation, the lateral portion 134, medial portion 136 and central portion 138 of the seal support region 116 each have an oval shape (e.g., an elliptical or at least substantially elliptical shape) in planes perpendicular to the medial-lateral axis ML that extends through the center of the seal carrier. The oval shapes defines respective major dimensions $D1_{MAJ}$, $D2_{MAJ}$ and $D3_{MAJ}$, respective minor dimensions $D1_{MIN}$, $D2_{MIN}$ and $D3_{MIN}$, and respective inner perimeters P1, P2 and P3. In the illustrated implementation, the inner perimeter P3 of the central portion 138 is smaller than the inner perimeters P1 and P2 of the lateral portion 134 and medial portion 136. Differences in inner perimeter size may be accomplished through differences in the major and/or minor dimensions and, in the illustrated embodiment, the differences in inner perimeter size may be accomplished through differences in both the major and minor dimensions. To that end, the major and minor dimensions $D3_{MAJ}$ and $D3_{MIN}$ of the central portion 138 are respectively less than the major and minor dimensions $D1_{MAJ}$ and $D1_{MIN}$ of the lateral portion 134 and are respectively less than the major and minor dimensions $D2_{MAJ}$ and $D2_{MIN}$ of the medial portion 136. The connector region 118 also has an oval shape.

Turning to the dimensional relationship between the exemplary seal carrier 108 and the hearing device core 200, and when core is fully inserted into the seal carrier (note FIG. 21), the inner perimeters P1 and P2 of the seal support region lateral and medial portions 134 and 136 are at least substantially equal in length (i.e., +/−1%) to the outer perimeter PC of the associated (i.e., aligned) portions of the core. The length of the inner perimeter P3 of the seal support region middle portion 138 less than (e.g., 7 to 10% less than) the outer perimeter PC of the associated portion of the core 200. Additionally, in the illustrated implementation, the major and minor dimensions $D3_{MAJ}$ and $D3_{MIN}$ of the seal support region central portion 138 are less than the respective major and minor dimensions $DC_{MAJ}$ and $DC_{MIN}$ of the associated portion of the core 200 (e.g., 7 to 10% less than), while the major and minor dimensions $DC_{MAJ}$ and $DC_{MIN}$ of the associated portions of the core are at least substantially equal to (i.e., +/−1%) the major and minor dimensions $D1_{MAJ}$ and $D1_{MIN}$ of the lateral portion 134 as well as the major and minor dimensions $D2_{MAJ}$ and $D2_{MIN}$ of the medial portion 136. It should also be noted that in those instances where the size of the core taper (or "decrease") slightly in the lateral to medial direction, seal support region 116 may taper correspondingly.

Figure 17:
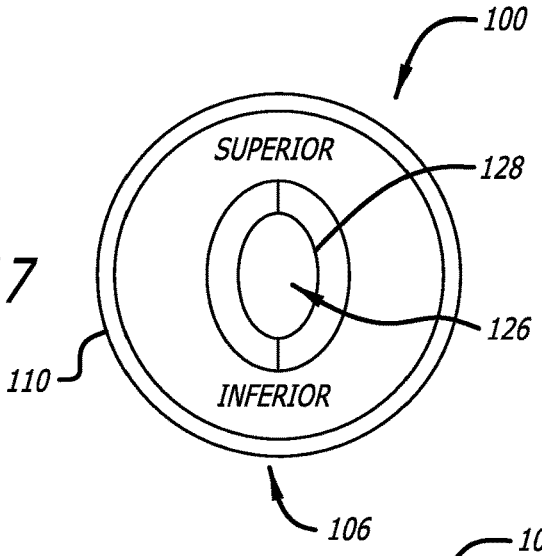
FIG. 17 is an end view of the hearing device seal module illustrated in FIG. 5.
Figure 18:
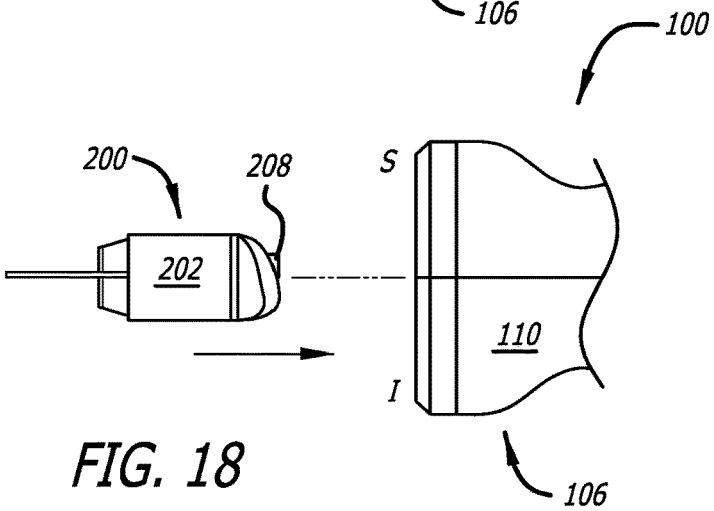
FIG. 18 is a side view showing a portion of an exemplary hearing device assembly method employing the hearing device seal module illustrated in FIG. 5.
Figure 19:
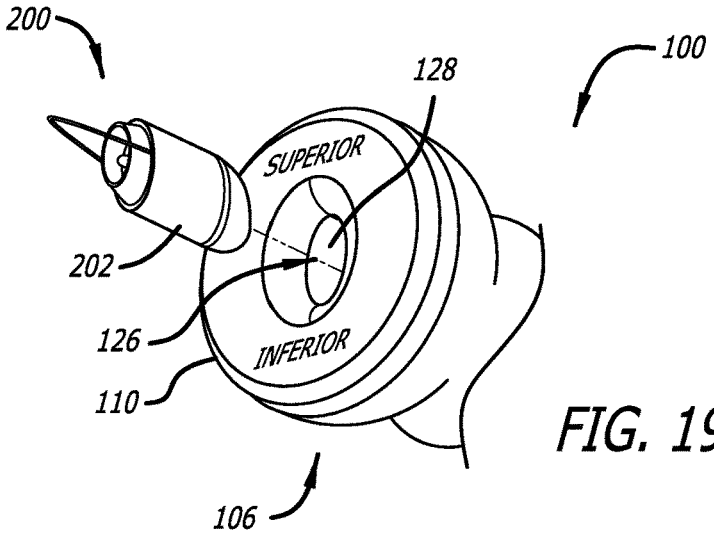
FIG. 19 is a perspective view showing a portion of an exemplary hearing device assembly method employing the hearing device seal module illustrated in FIG. 5.

As noted above with reference to FIG. 8, the receiver port 208 is not centered on the medial-lateral axis ML of the core 200. Additionally, the medial end 204 of the housing 202 has an inferior protrusion. The seal support region 116 in the illustrated embodiment may have a corresponding configuration. To that end, and referring to FIG. 13, the sound aperture 120 is also not centered on the medial-lateral axis ML and, as a result, the receiver port 208 will be aligned with the sound aperture 120 when the seal carrier 108 and hearing device core 200 are properly oriented relative to one another. The medial end 140 of the seal support region 116, which is closed but for the sound aperture, has an inferior protrusion. The handle 110 may be configured so as to increase the likelihood that the core 200 will be properly oriented relative to the seal carrier 108, and the receiver port 208 will be aligned with the sound aperture 120 when the core reaches the seal support region 116. For example, and referring to FIGS. 10 and 11, the lumen 126 has an oval shape that is similar in size to the hearing device core 200, which prevents the core from rotating relative to the handle 110 after the core has been inserted into the lumen inlet 128. The orientation of the lumen 126 relative to the seal carrier 108 is also such that the receiver port 208 will be aligned with the sound aperture 120 when the hearing device core 200 is inserted with the correct superior-inferior orientation. Accordingly, as shown in FIGS. 17-19, the handle 110 may in some instances be provided with indicia (such as the words "SUPERIOR" and "INFERIOR") that is indicative of the correct core orientation. The oval shape of the connector region 118 also helps maintain the intended orientation of the core 200.

Figure 19A:
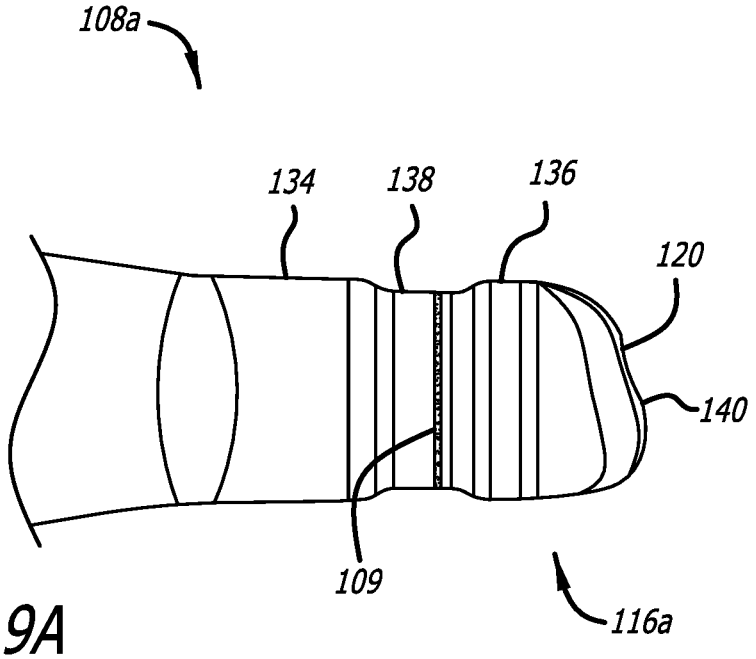
FIG. 19A is a side view of a portion of the hearing device seal module in accordance with one embodiment of a present invention.
Figure 19B:
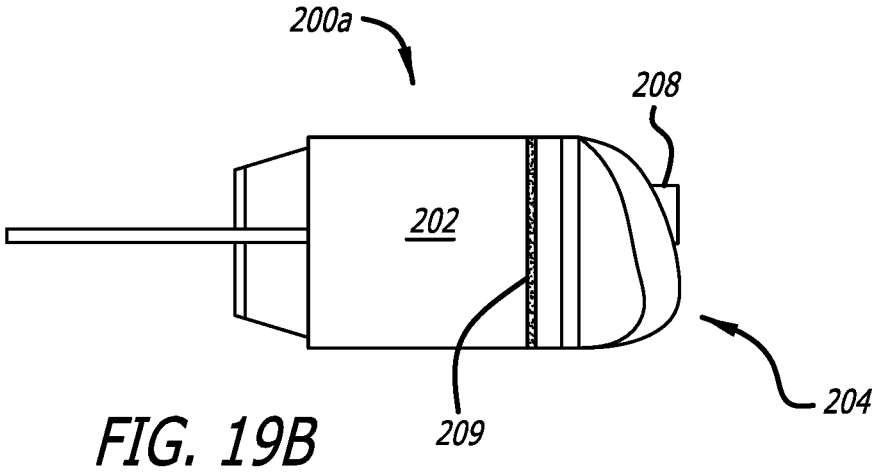
FIG. 19B a side view of a hearing device core in accordance with one embodiment of a present invention.
Figure 23:
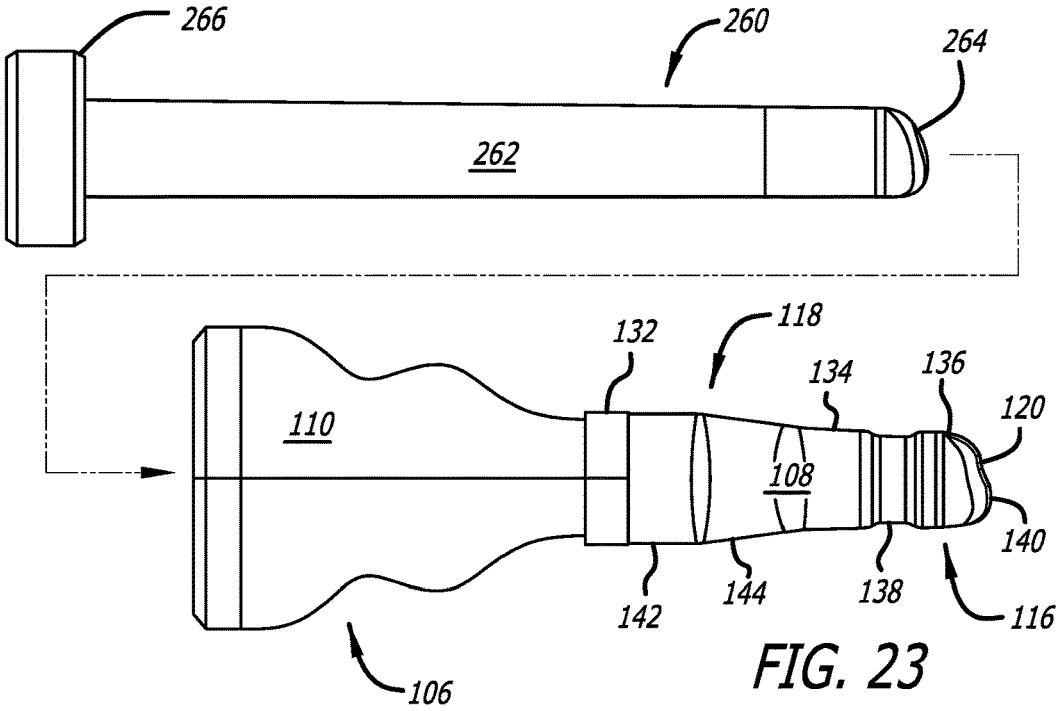
FIG. 23 is a side view showing a portion of an exemplary method of making the hearing device seal module illustrated in FIG. 5.
Figure 24:
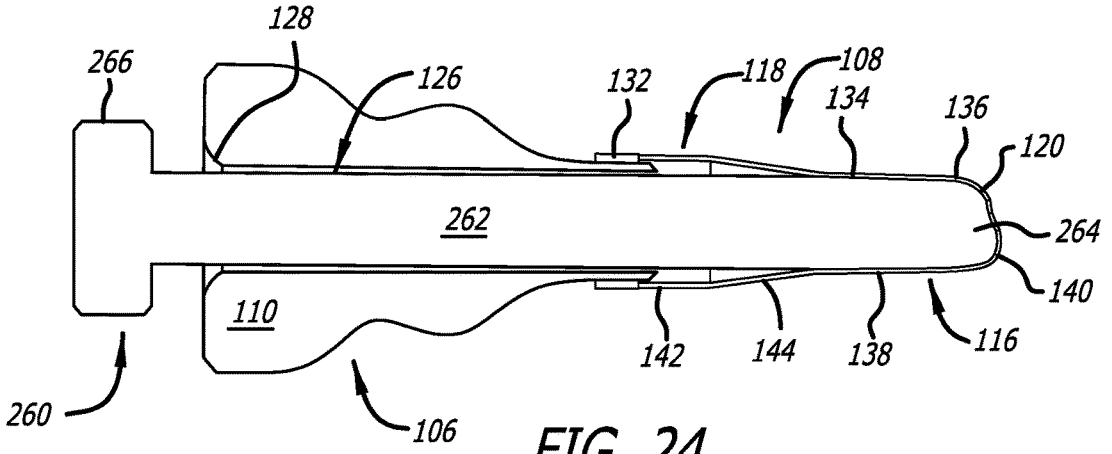
FIG. 24 is a side, partial section view showing a portion of an exemplary method of making the hearing device seal module illustrated in FIG. 5.
Figure 25:
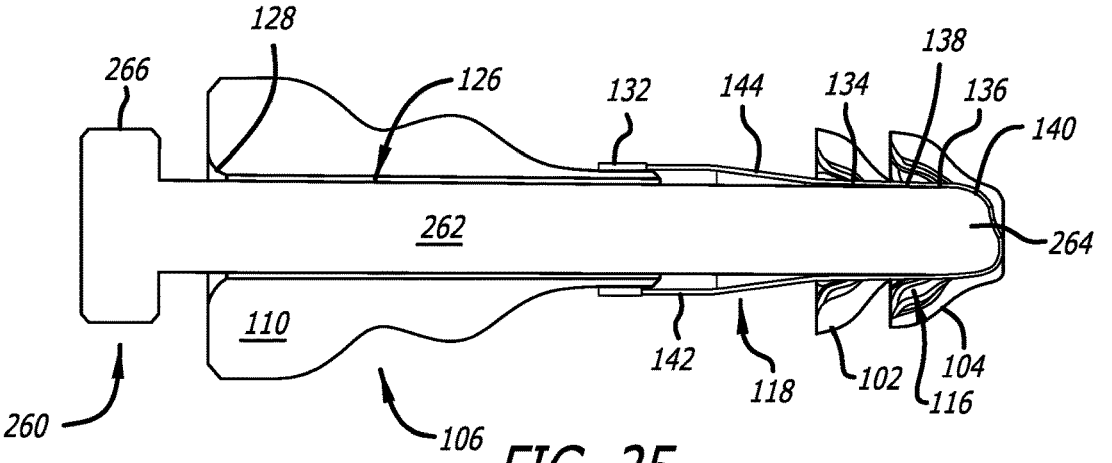
FIG. 25 is a side, partial section view showing a portion of an exemplary method of making the hearing device seal module illustrated in FIG. 5.
Figure 26:
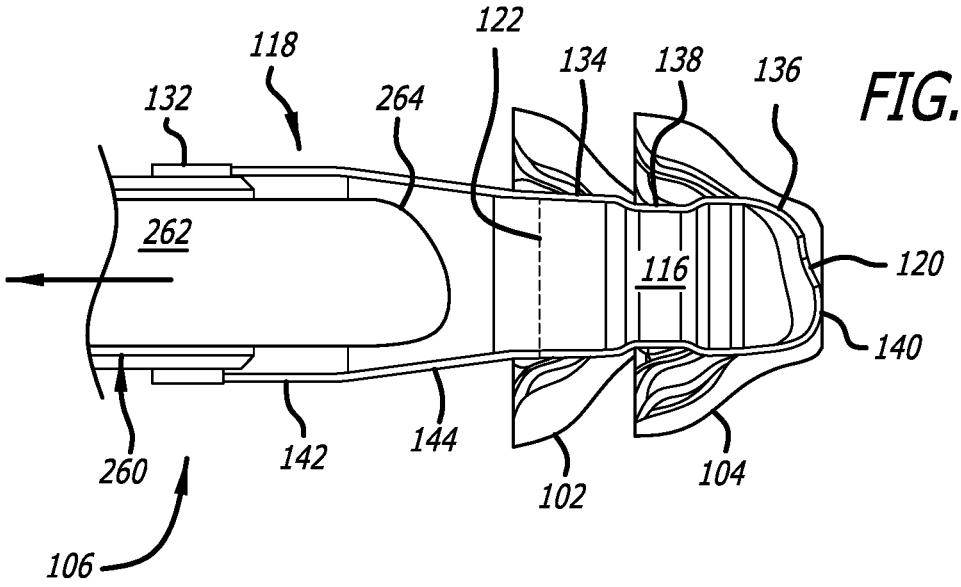
FIG. 26 is a side, partial section view showing a portion of an exemplary method of making the hearing device seal module illustrated in FIG. 5.

Another aspect of the assembly process is the alignment in the medial-lateral direction of the hearing device core 200 with the seal support region 116 so that the seals 102 and 104 will be accurately located on the core. To that end, in at least some implementations, the seal carrier 108 may be transparent or translucent and the seal carrier and hearing device core 200 may be provided with indicia that, when aligned with on another, indicate that the core is in the intended location in the medial-lateral direction. For example, and referring to FIGS. 19A and 19B, the exemplary seal carrier 108*a* includes a marker ring 109 and the core 200*a* includes a marker ring 209. The respective locations of the marker rings 109 and 209 are such that the core 200*a* will be properly aligned with the seal support region 116*a* when the marker rings are aligned with one another.

One exemplary method of securing one or more seals (e.g., seals 102) to a hearing device core (e.g., core 200) is illustrated in FIGS. 18, 19 and 20-22. The hearing device core 200 may be oriented in the intended manner and inserted into the handle lumen 126 in the manner illustrated in FIGS. 18 and 19. A tool may then be used to push the core 200 through the handle 110. By way of example, but not limitation, the tool 250 illustrated in FIG. 20 includes a rod 252 with a soft tip 254 on one end and a handle/stop 256 on the other end. The tool 250 may be used to push the hearing device core 200 from the location illustrated in FIG. 20 to the location illustrated in FIG. 21, with the soft tip 254 engaging the contamination guard 210. The exemplary seal module 100, core 200 and/or tool 250 may be configured so as to further increase the likelihood that the core will be properly aligned with the seal carrier 108 in the medial-lateral direction. For example, the respective lengths of the seal carrier 108, handle 110, core 200 and rod 252 may be such that handle/stop 256 will abut the handle 110 when the core medial end 204 abuts the medial end 140 of the seal support region 116 (FIG. 21).

As the core 200 moves through from the connector region 118 and into the seal support region 116, the core will stretch (or "stress" or "elastically deform") the central portion 138 of the seal support region. The resilience of the material used to form the connector region 118, and the tackiness of the material (if tacky), creates the above-described interference fit that semi-permanently secures the seals 102 and 104 to the core 200. It should be noted here that the strength of the weakened area 122 (FIGS. 13 and 21) is such that the weakened area will prevent the seal support region 116 from separating from the connector region 118 when exposed to the force associated with the core 200 be pushed into the seal support region. After the core 200 reaches the location illustrated in FIG. 21, the tool 250 may be withdrawn from the seal module 100. Thereafter, or concurrently, the seal support region 116 (and seals 102 and 104) may be separated from the connector region 118 (and remainder of the assembly apparatus 106) by simply pulling the two sets of elements apart with sufficient force to cause the weakened area 122 to fail. Failure of the weakened area 122 results in edges 122' and the separation of the hearing device 300 from the remainder of the assembly apparatus 106.

One exemplary method of securing one or more seals (e.g., seals 102 and 104) to the assembly apparatus 106 to form a hearing device seal module 100 is illustrated in FIGS. 23-26. The assembly apparatus 106 may first be supported on, for example, the exemplary tool 260. The exemplary tool 260 includes a mandrel 262 with a contoured region 264 at one end, having a shape that corresponds to that of the seal support region medial end 140, and a handle 266 at the other end. The cross-sectional size and shape of the mandrel 262 corresponds to that of the portion of the core 200 that will be aligned with the central portion 138 of the seal support region 116. As a result, when the mandrel 262 is inserted into the handle lumen 126 and through the seal carrier 108 in the manner illustrated in FIGS. 23 and 24, the mandrel will stretch the seal support region central portion 138. The mandrel 262 will also rest against the inner surface of the lateral portion 134 and a medial portion 136. The seals 102 and 104 may then be positioned on the seal support region 116, and secured thereto with adhesive or any other suitable instrumentality, in the manner illustrated in FIG. 25. The tool 260 may then be removed from the assembly apparatus 106 and complete the exemplary hearing device seal module 100 (FIGS. 5-7).

Figure 27:
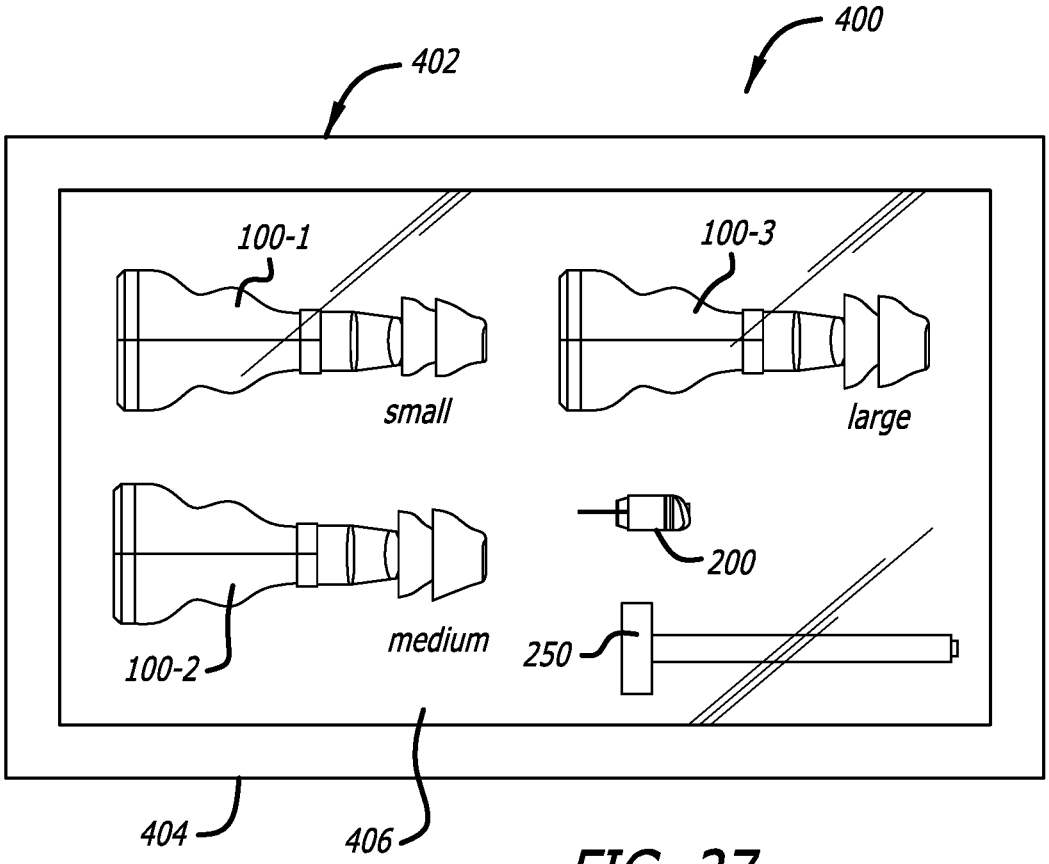
FIG. 27 is a plan view of a hearing device system in accordance with one embodiment of a present invention.

As noted above, one advantage associated with the present hearing device seal modules and methods is that they allow fitting facilities to store modules with a variety seal sizes, or size combinations, and to deploy them as needed. In other instances, fitting facilities may be provided with hearing device systems that include a hearing device core and a plurality of differently sized hearing device modules. At the time of fitting, the module with the appropriately sized seals may be used to secure the seals to the core. The remaining modules may discarded or placed into storage. One example of such a hearing device system, which is generally represented by reference numeral 400 in FIG. 27, includes seal modules 100-1 to 100-3 with differently sized seals, a core 200 and, in some instances, a tool 250, that are stored in packaging 402. The packaging 402 in the illustrated implementation includes a box or other enclosure 404 with a cover 406. The cover may be transparent, as shown, or opaque. Although there are three modules 100-1 to 100-3 in the illustrated implementation (labelled "small," "medium" and "large"), the number of modules may be increased or decreased. For example, modules with "extra-small," "extra-extra-small," "extra-large" and "extra-extra-large" seals may be provided.

Although the inventions disclosed herein have been described in terms of the preferred embodiments above, numerous modifications and/or additions to the above-described preferred embodiments would be readily apparent to one skilled in the art. By way of example, but not limitation, the present hearing device seal modules may include only one seal, or may include more than two seals. The inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device seal module for use with a hearing device core, comprising:

a tubular seal carrier, defining a medial-lateral axis and a lumen configured for passage of the hearing device core, and including a resilient seal support region;

the resilient seal support region being formed from resilient material and configured to receive therein the hearing device core, with a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the resilient seal support region is in an unstressed state; and a first seal on the first portion of the resilient seal support region and extending outwardly therefrom.

2. The hearing device seal module claimed in claim 1, wherein the resilient seal support region comprises an oval resilient seal support region.

3. The hearing device seal module claimed in claim 2, wherein the first portion of the resilient seal support region defines a first portion major dimension and a first portion minor dimension; and the second portion of the resilient seal support region defines a second portion major dimension that is less than the first portion major dimension and a second portion minor dimension that is less than the first portion minor dimension.

4. The hearing device seal module claimed in claim 3, wherein the resilient seal support region includes a third portion, lateral of the second portion, defining a third portion perimeter in a plane perpendicular to the medial-lateral axis that is greater than the second portion perimeter when the resilient seal support region is in an unstressed state.

5. The hearing device seal module claimed in claim 4, further comprising:

a second seal on the third portion of the resilient seal support region and extending outwardly therefrom.

6. A hearing device seal module for use with a hearing device core, comprising:

a tubular seal carrier formed from resilient material, defining a medial-lateral axis and a lumen configured for passage of the hearing device core, and including an oval seal support region with a first portion defining a first portion perimeter in a plane perpendicular to the medial-lateral axis, a first portion major dimension and a first portion minor dimension, a second portion, lateral of the first portion, defining a second portion perimeter in a plane perpendicular to the medial-lateral axis that is less than the first portion perimeter when the seal support region is in an unstressed state, a second portion major dimension that is less than the first portion major dimension and a second portion minor dimension that is less than the first portion minor dimension, and a third portion, lateral of the second portion, defining a third portion perimeter in a plane perpendicular to the medial-lateral axis that is greater than the second portion perimeter when the seal support region is in an unstressed state, a third portion major dimension that is greater than the second portion major dimension and a third portion minor dimension that is greater than the second portion minor dimension;

a first seal secured to the first portion of the seal support region and extending outwardly therefrom; and a second seal secured to the third portion of the seal support region and extending outwardly therefrom.

7. The hearing device seal module claimed in claim 1, further comprising:

a handle, defining a lumen configured for passage of the hearing device core, operably connected to the tubular seal carrier.

8. The hearing device seal module claimed in claim 7, wherein the tubular seal carrier includes a connector region lateral of the resilient seal support region and a weakened area between the connector region and the resilient seal support region.

9. A hearing device seal module for use with a hearing device core, comprising:

a tubular seal carrier formed from resilient material, defining a medial-lateral axis and a lumen configured for passage of the hearing device core, and including a seal support region with a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the seal support region is in an unstressed state, a connector region lateral of the seal support region, and a weakened area between the connector region and the seal support region;

a first seal secured to the first portion of the seal support region and extending outwardly therefrom; and a handle, defining a lumen configured for passage of the hearing device core, secured to the connector region of the tubular seal carrier.

10. The hearing device seal module claimed in claim 1, wherein the resilient seal support region includes a closed medial end with a sound aperture extending therethrough.

11. A hearing device system, comprising:

a first hearing device seal module as claimed in claim 1; and a hearing device core defining a medial-lateral axis and a core perimeter in a plane perpendicular to the medial-lateral axis that is greater than the second portion perimeter of the resilient seal support region.

12. The hearing device system claimed in claim 11, wherein the hearing device core includes a battery, a microphone, a receiver, and control circuitry that are operably connected to one another.

13. The hearing device system claimed in claim 11, further comprising:

a second hearing device seal module as claimed in claim 1;

wherein the first and second hearing device seal modules do not have the same sized seals.

14. A method, comprising the step of:

positioning a hearing device seal module, including a resilient tubular seal carrier with a resilient seal support region and a first seal on the resilient seal support region prior to the positioning, onto a hearing device core with a receiver port in such a manner that a portion of the resilient seal support region that is lateral of and adjacent to the first seal is stretched over the hearing device core and the hearing device core receiver port is medial of the stretched portion of the resilient seal support region.

15. The method claimed in claim 14, wherein an interference fit between the hearing device core and the tubular seal carrier is created when the portion of the tubular seal carrier that is lateral of the first seal is stretched over the hearing device core.

16. The method claimed in claim 15, wherein the interference fit between the hearing device core and the tubular seal carrier semi-permanently secures the first seal to the hearing device core.

17. The method claimed in claim 14, wherein the hearing device core includes a receiver port;

the resilient tubular seal carrier includes a sound aperture; and positioning the hearing device seal module onto the hearing device core further comprises aligning the sound aperture with the receiver port.

18. The method claimed in claim 14, further comprising the step of:

removing a portion of the tubular seal carrier after the portion of the tubular seal carrier that is lateral of the first seal is stretched over the hearing device core.

19. The method claimed in claim 14, wherein a second seal is secured to the resilient seal support region at a location that is lateral of the portion of the tubular seal carrier that is lateral of and adjacent to the first seal and is stretched over the hearing device core.

* * * * *